United States Patent [19]

Bowles, Jr.

[11] 4,283,046

[45] Aug. 11, 1981

[54] SEAT CONSTRUCTION

[75] Inventor: Louis G. Bowles, Jr., High Point, N.C.

[73] Assignee: Gulf & Western Manufacturing Company, Southfield, Mich.

[21] Appl. No.: 69,581

[22] Filed: Aug. 24, 1979

[51] Int. Cl.[3] ..... A47C 7/02

[52] U.S. Cl. ..... 267/102; 297/452

[58] Field of Search ..... 267/86, 102, 103, 104, 267/106, 109, 110; 297/452

[56] References Cited

U.S. PATENT DOCUMENTS

| | | | |
|---|---|---|---|
| 3,292,921 | 12/1966 | Winkler et al. | 267/110 |
| 3,497,883 | 3/1970 | Arnold et al. | 297/452 X |
| 3,639,002 | 2/1972 | Tischler | 297/452 |
| 3,888,473 | 6/1975 | Mandusky et al. | 267/102 |

*Primary Examiner*—Duane A. Reger

*Attorney, Agent, or Firm*—Barnes, Kisselle, Raisch & Choate

[57] ABSTRACT

A seat construction comprising a spring assembly including a pair of longitudinally extending wires, a plurality of transversely extending spaced spring wires, portions of which are wound around the longitudinally extending wires to define an intermediate portion extending between the spaced longitudinally extending wires and free ends extending beyond the longitudinally extending wires. An additional longitudinally extending wire is connected to the free ends of the transversely extending wires along each end of the longitudinally extending wires. The portions of the transversely extending wires between one of the first-mentioned longitudinally extending and one of the additional longitudinally extending wires is curved so that that additional longitudinally extending wire is spaced from the plane of the remaining longitudinally extending wires. When utilized in a furniture construction including a top and bottom rail, the additional longitudinally extending wires are fastened to these rails directly or by the utilization of springs.

21 Claims, 14 Drawing Figures

FIG. 13
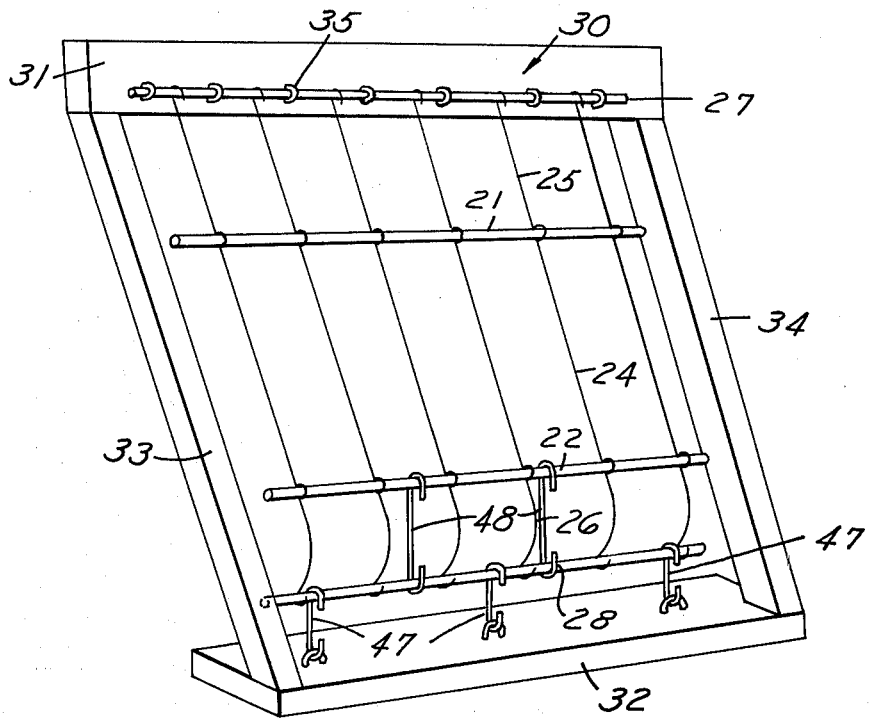
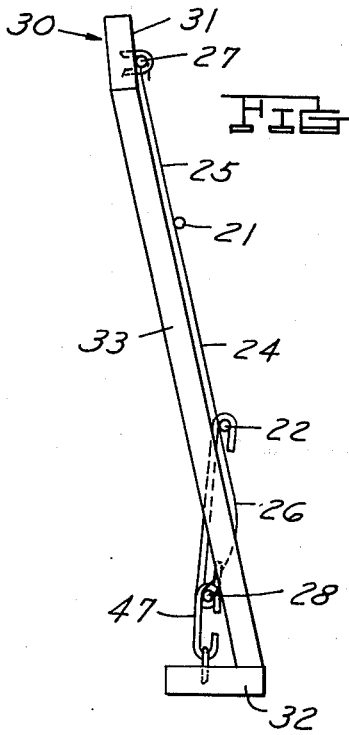
FIG. 14

SEAT CONSTRUCTION

This invention relates to seat construction such as furniture construction.

BACKGROUND AND SUMMARY OF THE INVENTION

In an effort to make lightweight and low cost seats while maintaining the desired support and comfort, it has heretofore been proposed that spring assemblies be utilized that comprise a plurality of longitudinally extending wires and a plurality of transversely spaced wires wound around the longitudinally extending wires with additional longitudinally extending wires connecting the free ends of the transversely spaced wires. See, for example, U.S. Pat. Nos. 3,639,002, 3,727,980 and 3,880,467, having a common assignee with the present application.

Among the objects of the invention are to provide a seat construction utilizing similar spring assemblies having a configuration that is particularly adapted for use in making a seat back such as in the back of furniture which produces a low cost, comfortable seat back.

In accordance with the invention, the spring assembly is modified so that one of the additional longitudinally extending wires which connects the free ends of the transversely spaced wires is displaced from the plane of the remainder of the longitudinally extending wires and the portions of the transversely extending wires between the one additional longitudinally extending wire and the adjacent longitudinally extending wire are curved when the spring assembly is in the untensioned state. The spring assembly is mounted on a seat back frame with the additional longitudinally extending wires connected directly or through springs to the top and bottom rails of the seat back frame.

DESCRIPTION OF THE DRAWINGS

FIG. 13 is a perspective view of a further modified form of the invention.

FIG. 14 is a side view of the same.

DESCRIPTION

Figure 11:
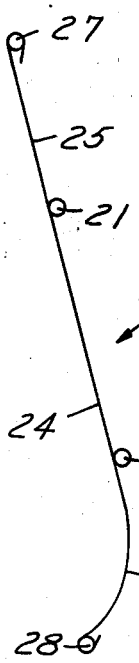
FIG. 11 is a side elevational view of the spring assembly utilized in the various forms of the invention.
Figure 12:
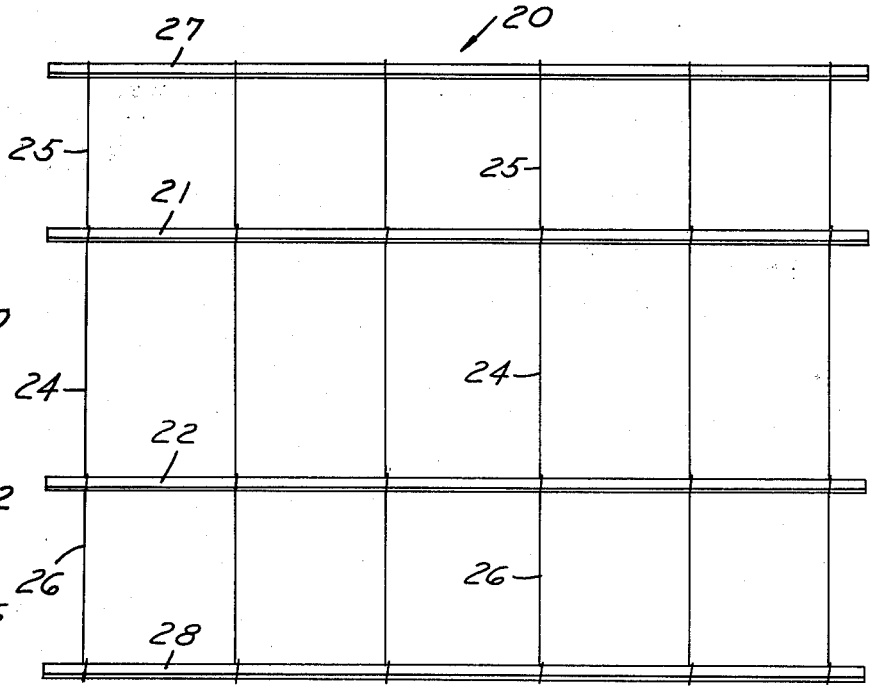
FIG. 12 is a plan view of the same.

Referring to FIGS. 11 and 12, the invention contemplates utilization of a spring assembly 20 comprising spaced longitudinally extending wires 21, 22 and spaced transversely extending wires 23 of oil-tempered spring steel. The wires 23 include intermediate portions 24, the ends of which are wound twice around the wires 21, 22 and extend in a free manner as at 25, 26. The free ends of the portions 25, 26 are attached by a single loop about additional first and second longitudinally spaced wires 27, 28, respectively. Wires 21, 22, 27, 28 are preferably made of steel wrapped with paper or coated with plastic so that they have a resilient surface.

The portions 26 between the longitudinally extending wire 22, 28 are curved so that the longitudinally extending wire 28 is spaced from the general plane of the longitudinally extending wires 22, 21, 27.

Figure 1:
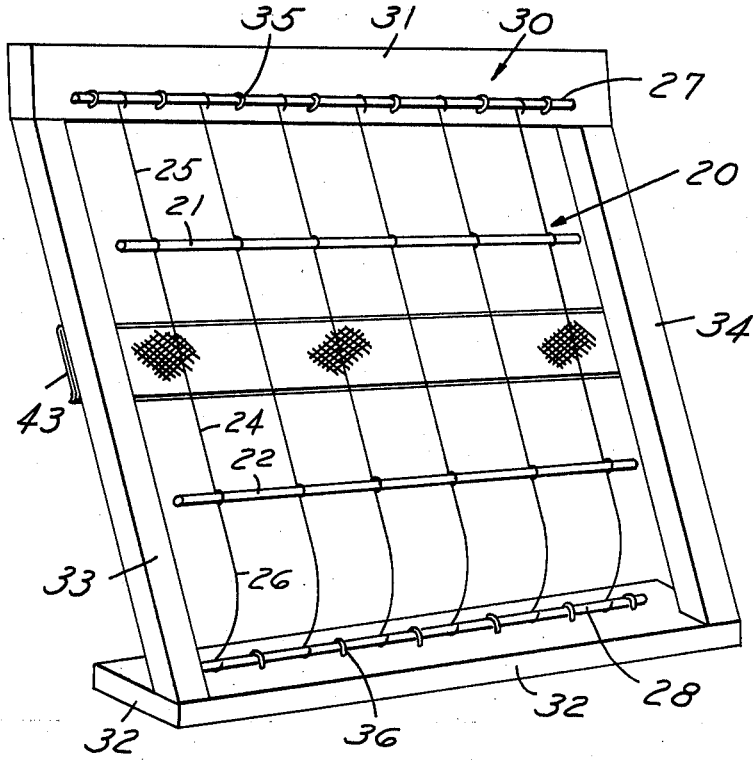
FIG. 1 is a perspective view of a seat back embodying the invention.
Figure 2:
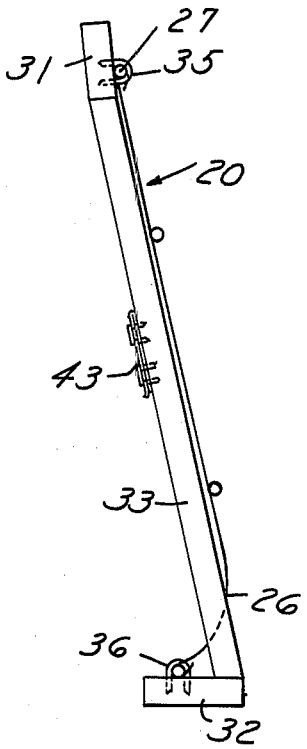
FIG. 2 is a side elevational view of the same.

Referring to FIG. 1, the spring assembly can be utilized in a seat back frame 30 having a top rail 31, a bottom rail 32 and side rails 33, 34 and is mounted with the longitudinally extending wires 27, 21, 22, 28 extending horizontally, the longitudinally extending wire 27 being fastened to the top rail 31 and the longitudinally extending wire 28 being fastened to the bottom rail 32. As shown in FIGS. 1 and 2, the longitudinally extending wires 27, 28 are fastened by staples 35, 36 with the wire 27 on the side surface of rail 31 and the wire 28 on the top surface of rail 32. The position of the longitudinally extending wire 28 is such that the portion 26 is placed under a further tension as viewed in FIGS. 1 and 2. When provided with appropriate padding or cushioning, the spring assembly 20 thus provides proper support to the back and the lower portion as at 26 supports the lumbar portion of the body of the user of the seat.

Figure 3:
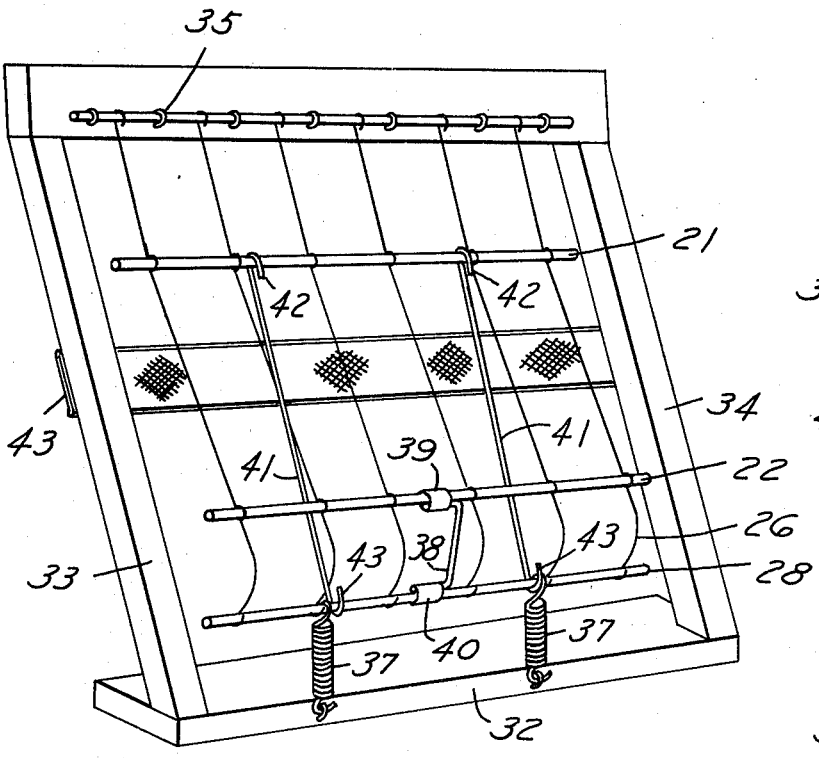
FIG. 3 is a perspective view of a modified form of seat back.
Figure 4:
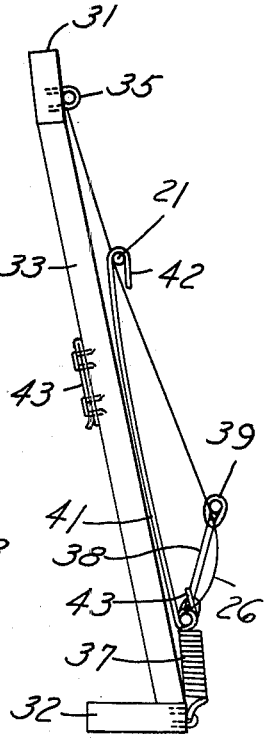
FIG. 4 is a side elevational view of the same.

In the form of the invention shown in FIGS. 3 and 4, the upper longitudinally extending wire 27 is fastened by staples as in the form of the invention shown in FIGS. 1 and 2 and the lower wire 28 is connected to the bottom rail 32 by tension springs 37 extending between the wire 28 and the side surface of the bottom rail 32. Where additional support is needed or desired for the user, a rigid stabilizer wire in the form of a U is provided as at 38 and is connected by clips 39, 40 to the longitudinally extending wires 22, 28. The length of the stabilizer wire 38 is preferably such that the portion 26 of the spring assembly is further tensioned or bowed outwardly. Additional stiffening can be provided by a rigid restraining wire 41 which has a hook 42 at the upper end hooked on the longitudinally extending wire 21 and a hook 43 at its lower end hooked about the longitudinally extending wire 28.

Figure 5:
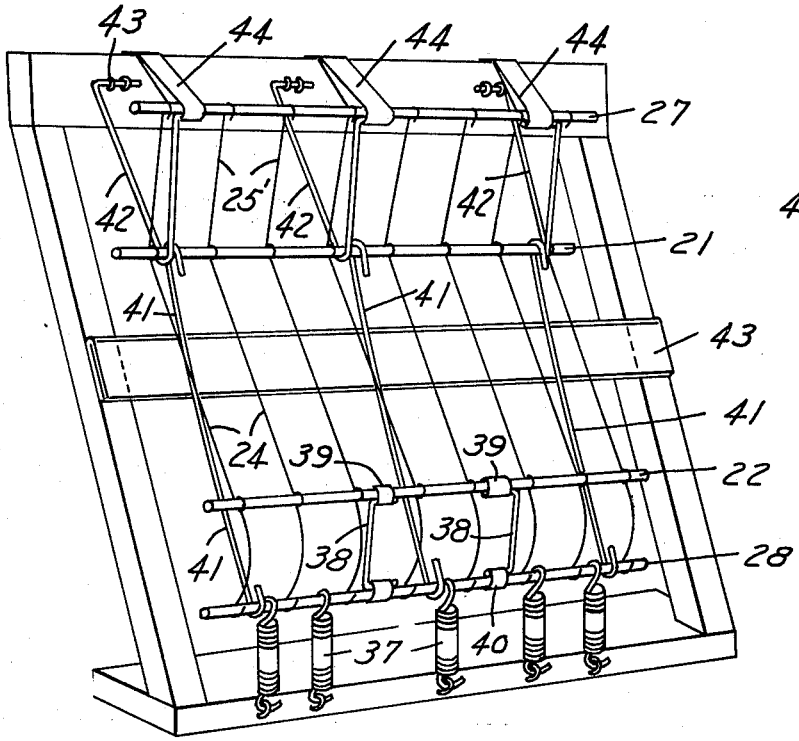
FIG. 5 is a perspective view of a further modified form of seat back.
Figure 6:
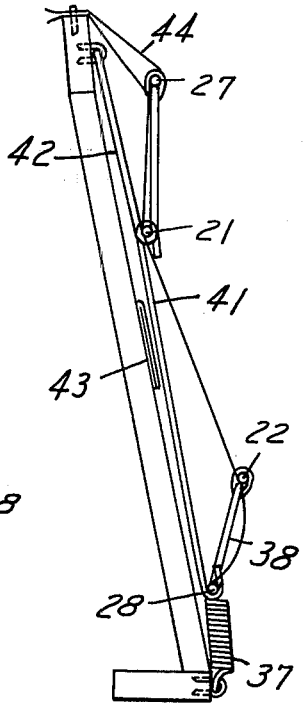
FIG. 6 is a side view of the same.

In the form of the invention shown in FIGS. 5 and 6, the lower longitudinally extending wire 28 is fastened to the lower rail by tension springs 37 as in the form shown in FIGS. 3 and 4, and includes rigid restraining wires 41 and rigid stabilizer wires 38. The spring assembly is modified so that the portions 25' between the wires 21 and 27 are bent out of the plane of the portions 24. V-shaped hanger springs 42 have arms which are pivotally fastened by staples 43 to the top rail at one lateral end and clipped at the other lateral end to the top wire 27 with the intermediate portion connecting the arms of the spring 42 passing about the longitudinally extending wire 21. Straps 44 limit the outward movement of the wire 27 under action of the spring 42.

Figure 7:
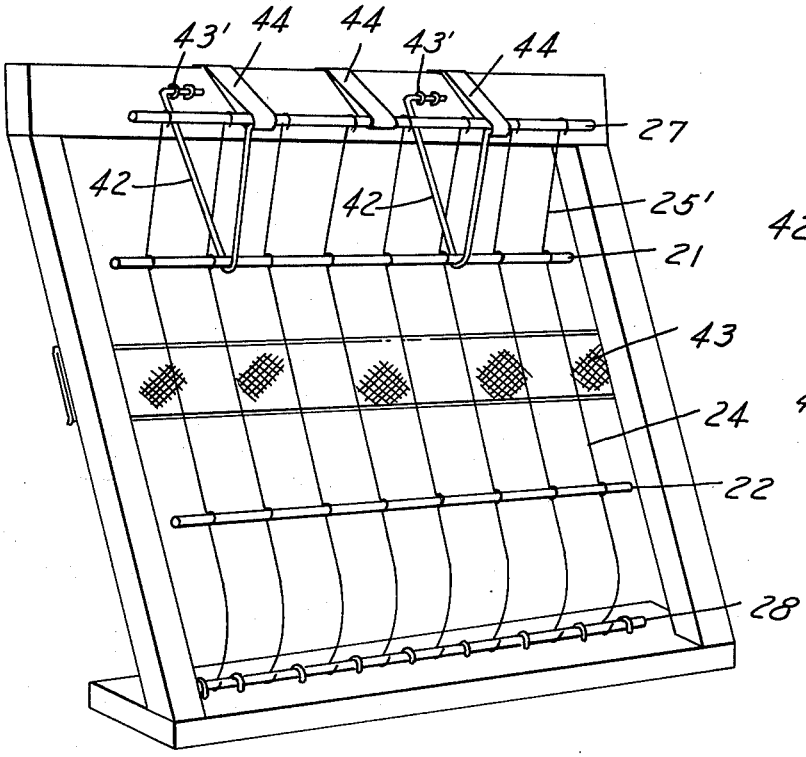
FIG. 7 is a perspective view of a further modified form of seat back.
Figure 8:
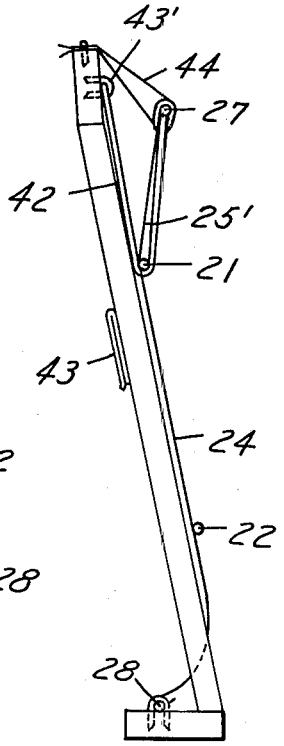
FIG. 8 is a side view of the same.

The form of the invention shown in FIGS. 7 and 8 is similar to that shown in FIGS. 5 and 6 except that the lower wire 28 is fastened directly to the bottom rail by staples and the stabilizer wire 38 and restraining wire 41 are omitted.

Figure 9:
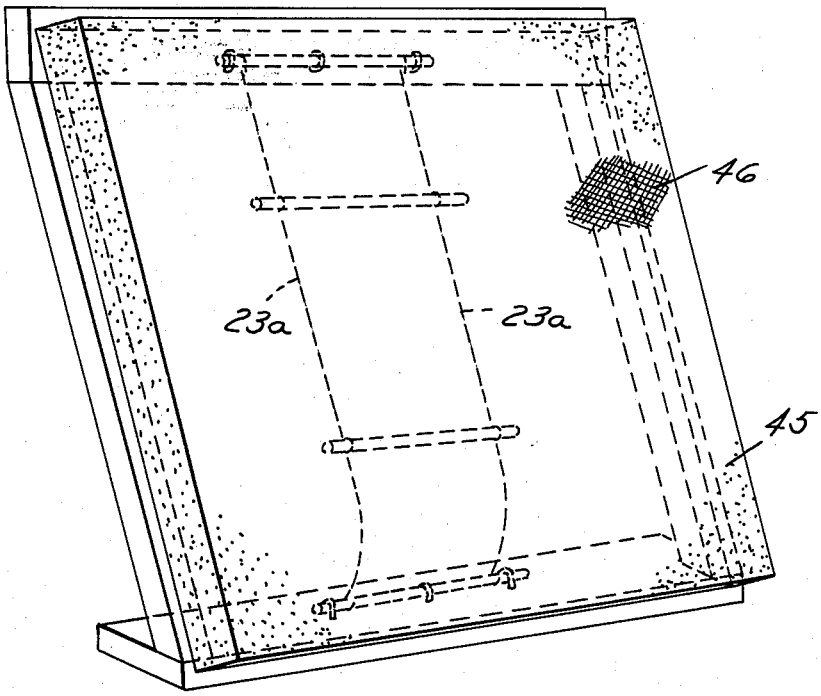
FIG. 9 is a perspective view of an additional modified form of seat back.
Figure 10:
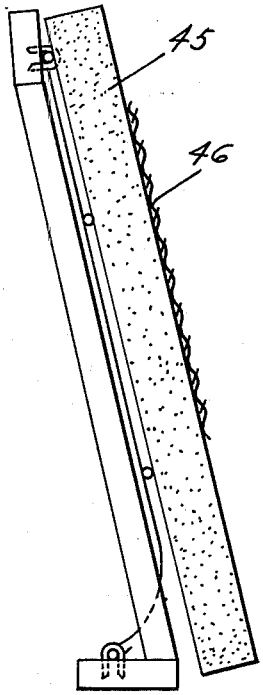
FIG. 10 is a side elevational view of the same.

In the form of the invention shown in FIGS. 9 and 10, the spring assembly is similar to that shown in FIGS. 1 and 2 except it has only two transversely extending wires **23*a* and a cushion 45 is laid on the spring assembly and held in position by upholstery material 46** enveloping the cushion and fastened to the frame. The spring assembly thus provides a support for the cushion but the major resiliency in the seat back is achieved by the cushion rather than the spring assembly.

The form of the invention set forth in FIGS. 13 and 14 is similar to that shown in FIGS. 1 and 2 except that the longitudinally extending wire 28 is fastened to the top surface of the bottom rail 32 by rigid wire members 47 having hooks at each end, one hook engaging the wire 28 and the other hook being fastened to the rail 32 by a staple. This form further includes hooks 48 engaging the lower wire 28 and the adjacent wire 22.

In each of the forms of the invention, a cross strap 43 of burlap or the like can be provided between the rear surfaces of the side rails 33, 34 of the frame 30 to prevent inward movement of the upholstery fabric on the back of the frame.

I claim:

1. In a seat construction, a spring assembly comprising a pair of longitudinally extending wires, a plurality of transversely extending spaced spring wires, portions of said transversely extending spaced spring wires being wound around said longitudinally extending wires to define an intermediate portion extending between the spaced longitudinally extending wires and free ends extending beyond the longitudinally extending wires at an acute angle to the intermediate portion, an additional longitudinally extending wire connecting the free ends of said transversely extending spring wires along each said first-mentioned longitudinally extending wires, the portions of said transversely extending spaced spring wires between one said additional longitudinally extending wires and the adjacent longitudinally extending wire being curved so that said one additional longitudinally extending wire is displaced out of the general plane of the remainder of said longitudinally extending wires.

2. The spring assembly set forth in claim 1 wherein said longitudinally extending wires include an outer resilient layer.

3. The spring assembly set forth in claim 1 including an upright back frame having top and bottom rails, means for fastening said one additional longitudinally extending wire to the bottom rail, and means fastening the other said longitudinally extending wire to the top rail.

4. The spring assembly set forth in claim 3 wherein said point of fastening of said one additional longitudinally extending wire is such that the curved portions of said transversely extending wires are placed under tension.

5. The spring assembly set forth in claim 3 wherein said means for fastening said one additional longitudinally extending wire comprises fasteners directly mounting said one additional wire to said frame.

6. The spring assembly set forth in claim 3 wherein said other additional longitudinally extending wire is fastened to the upper surface of said bottom rail.

7. The spring assembly set forth in claim 3 wherein said means for fastening said other of said additional longitudinally extending wires fastens said wire directly to the top rail.

8. The spring assembly set forth in claim 3 wherein said means fastening said one additionally extending wire to said bottom rail comprises tension springs.

9. The spring assembly set forth in claim 3 including at least one stabilizer wire extending between and connected to said one additionally extending longitudinal wire and the adjacent longitudinally extending wire.

10. The spring assembly set forth in claim 3 including a restraining wire extending between said one additional longitudinally extending wire and one of said first-mentioned longitudinally extending wires.

11. The spring assembly set forth in claim 3 including a stabilizer wire extending between and connected to said one additional longitudinally extending wire and the adjacent longitudinally extending wire, and a restraining wire extending between said one additional longitudinally extending wire and another of said first-mentioned longitudinally extending wires.

12. The spring assembly set forth in claim 3 wherein said means for fastening the other longitudinally extending wire to the top rail comprises a hanger spring having a pair of legs connected to one another, one of said legs being fastened to said top rail and the other of said legs being fastened to the other of said longitudinally extending wires with the connecting portions of said hanger spring engaging the longitudinally extending wire adjacent to the other additional longitudinally extending wire.

13. The spring assembly set forth in claim 12 wherein said means for fastening the one additional longitudinally extending wire to said bottom rail comprises a plurality of tension springs extending between said one additional longitudinally extending wire and said bottom rail.

14. The spring assembly set forth in claim 12 wherein said means for fastening said one additional longitudinally extending wire to said bottom rail comprises means for fastening said wire directly to said bottom rail.

15. The spring assembly set forth in claim 3 including a pad and upholstery means holding said pad on said spring assembly and fastened to said frame.

16. The spring assembly set forth in claim 3 wherein said means for fastening said one additional longitudinally extending wire to said bottom rail comprises a plurality of members having hooks at each end, one hook engaging the additional longitudinally extending wire, and staple means fastening the other hook to said bottom rail.

17. The spring assembly set forth in claim 1 including at least one stabilizer wire extending between and connected to said one additionally extending longitudinal wire and the adjacent longitudinally extending wire.

18. The spring assembly set forth in claim 1 including a restraining wire extending between said one additional longitudinally extending wire and one of said first-mentioned longitudinally extending wires.

19. The spring assembly set forth in claim 1 including a stabilizer wire extending between and connected to said one additional longitudinally extending wire and the adjacent longitudinally extending wire, and a restraining wire extending between said one additional longitudinally extending wire and another of said first-mentioned longitudinally extending wires.

20. The spring assembly set forth in claim 17 including means for fastening the other longitudinally extending wire to a top rail of a frame comprising a hanger spring having a pair of legs connected to one another, one of said legs being adapted to be fastened to said top rail and the other of said legs being fastened to the other of said longitudinally extending wires with the connecting portions of said hanger spring engaging the longitudinally extending wire adjacent to the other additional longitudinally extending wire.

21. The spring assembly set forth in claim 1 wherein said portions of said transversely extending spaced wires are wound tightly around said longitudinally extending wires.

* * * * *